US009979083B2

(12) United States Patent
Simmonds

(10) Patent No.: US 9,979,083 B2
(45) Date of Patent: May 22, 2018

(54) RADIO EQUIPMENT POSITIONING

(71) Applicant: Christopher Martin Simmonds, Andover, MA (US)

(72) Inventor: Christopher Martin Simmonds, Andover, MA (US)

(73) Assignee: ALTIOSTAR NETWORKS, INC., Tewksbury, MA (US)

( * ) Notice: Subject to any disclaimer, the term of this patent is extended or adjusted under 35 U.S.C. 154(b) by 190 days.

(21) Appl. No.: 14/752,288

(22) Filed: Jun. 26, 2015

(65) Prior Publication Data

US 2016/0380351 A1 Dec. 29, 2016

(51) Int. Cl.
*H01Q 3/08* (2006.01)
*H01Q 1/12* (2006.01)

(52) U.S. Cl.
CPC ..... *H01Q 3/08* (2013.01); *H01Q 1/1228* (2013.01)

(58) Field of Classification Search
CPC .... H04B 7/0617; H04B 17/26; H04B 17/309; H04B 7/024; H04B 7/0689; H04B 17/318; H04B 7/0695; H04B 7/18597; H04B 7/0602; H04B 7/0834; H04B 7/088; H04B 17/391; H04B 1/3827; H04B 1/7117
See application file for complete search history.

(56) References Cited

U.S. PATENT DOCUMENTS

2012/0083226 A1* 4/2012 Kenington ..... H04B 17/0085 455/88
2016/0191131 A1* 6/2016 Balraj ..... H04B 7/0617 375/267

* cited by examiner

*Primary Examiner* — Kwasi Karikari
(74) *Attorney, Agent, or Firm* — Mintz Levin Cohn Ferris Glovsky and Popeo, P.C.

(57) ABSTRACT

A device, a method, a system, and a computer program product for installation, positioning and/or repositioning of a radio device are disclosed. Using a positioning device, an identification information of the radio device and at least one first positioning parameter associated with the radio device are received for positioning of the radio device on an installation surface. The positioning device determines at least one second positioning parameter of the radio device. The first and second positioning parameters are compared and the radio device is positioned based on at least one of the following: the first positioning parameter and the second positioning parameter.

18 Claims, 8 Drawing Sheets

RADIO EQUIPMENT POSITIONING

TECHNICAL FIELD

In some implementations, the current subject matter described herein generally relates to installation of radio equipment in a communications system, such as in Long Term Evolution (LTE) wireless communications systems.

BACKGROUND

Modern wireless networks provide communications capabilities to a variety of devices, such as cellular telephones, computers, smartphones, tablets, etc. A wireless network is typically distributed over land areas, which are called cells. Each such cell is served by at least one fixed-location transceiver, which is referred to as a cell site or a base station. Each cell can use a different set of frequencies than its neighbor cells in order to avoid interference and provide guaranteed bandwidth within each cell. When cells are joined together, they provide radio coverage over a wide geographic area, which enables a large number of mobile telephones, and/or other wireless devices or portable transceivers to communicate with each other and with fixed transceivers and telephones anywhere in the network.

The base stations are typically coupled to or otherwise include a radio equipment, such as an antenna that can receive and/or transmit wireless signals to wireless devices and/or to other base stations. The radio equipment is typically located above ground at a predetermined height and is positioned in a certain fashion to ensure adequate radio coverage as well as receipt/transmission of signals. Installation of such radio equipment in macro cells (providing radio coverage to large areas) can typically be performed without regard to a particular orientation.

However, in small cell deployment, proper orientation and positioning of the radio equipment can be very important to providing adequate radio coverage. Vendors of conventional systems typically provide its installers with location and orientation information of a desired boresight for an antenna as determined during planning of a wireless network, but the actual physical deployment may not be fully known to the installer. Further, location of a small cell and its antenna can be more arbitrary. The installer may know the desired location to a reasonable degree of accuracy (e.g., location of a pole on which radio equipment will be installed), but may not know wall position, height, angle, close-by alternatives, etc. for installation at the time of deployment. Further, the boresight angle may not be easily measured due to position of the installer. Additionally, use or accuracy of a standard compass bearing may not be as easily realized, compared to standing on a tower next to the large panel antenna. This can result in an incorrect location and/or orientation of the radio equipment, which can result in an unexpected coverage, interference, degradation of system performance, as well as other issues. Thus, there is a need for a system that can allow proper installation of the radio equipment.

SUMMARY

In some implementations, the current subject matter relates to a computer-implemented method for installation, positioning and/or repositioning of a radio device. The method can include receiving, using a positioning device, an identification information of the radio device and at least one first positioning parameter associated with the radio device for positioning of the radio device on an installation surface, determining, using the positioning device, at least one second positioning parameter of the radio device, comparing, using the positioning device, the first positioning parameter and the second positioning parameter, and positioning, based on the comparison, the radio device based on at least one of the following: the first positioning parameter and the second positioning parameter.

In some implementations, the current subject matter can include one or more of the following optional features. The radio device can be communicatively coupled to an evolved node (eNodeB) base station. The eNodeB base station can include at least one processor and at least one memory.

In some implementations, the first positioning parameter and the second positioning parameter can include at least one of the following: a boresight of the radio device, a tilt of the radio device, and/or a pan of the radio device.

In some implementations, the positioning device can be coupled to the radio device. Then, the boresight of the radio device, the tilt of the radio device, and the pan of the radio device can be determined based on at least one corresponding boresight of the radio device, tilt of the radio device, and pan of the positioning device.

In some implementations, the positioning device can remotely communicate with the radio device. Here, the boresight of the radio device, the tilt of the radio device, and the pan of the radio device can also be determined based on at least one corresponding boresight of the radio device, tilt of the radio device, and pan of the positioning device.

In some implementations, at least one of the boresight of the radio device, the tilt of the radio device, and the pan of the radio device can be determined based on at least one of the following: a location of the radio device, a height of the radio device above a ground surface, a compass angle of the radio device, a photograph of the radio device, a tilt angle of the radio device, an angle of the radio device with respect to a vertical axis, and an angle of the radio device with respect to Magnetic North.

In some implementations, the method can further include determining, based on the comparison, that the radio device has been incorrectly positioned, and repositioning the radio device based on at least one of the following: the first positioning parameter and the second positioning parameter.

Articles are also described that comprise a tangibly embodied machine-readable medium embodying instructions that, when performed, cause one or more machines (e.g., computers, etc.) to result in operations described herein. Similarly, computer systems are also described that can include a processor and a memory coupled to the processor. The memory can include one or more programs that cause the processor to perform one or more of the operations described herein. Additionally, computer systems may include additional specialized processing units that are able to apply a single instruction to multiple data points in parallel.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE DRAWING

The accompanying drawings, which are incorporated in and constitute a part of this specification, show certain aspects of the subject matter disclosed herein and, together with the description, help explain some of the principles associated with the disclosed implementations. In the drawings.

DETAILED DESCRIPTION

To address the deficiencies of currently available solutions, one or more implementations of the current subject matter relate to systems, methods, devices, and/or computer program products for positioning, maintenance, and/or performing other functions in connection with installation of small cells in wireless communications systems.

In some implementations, the current subject matter can be implemented in a wireless communication system, such as a Long Term Evolution system, where some of its components are discussed below.

Figure 1:
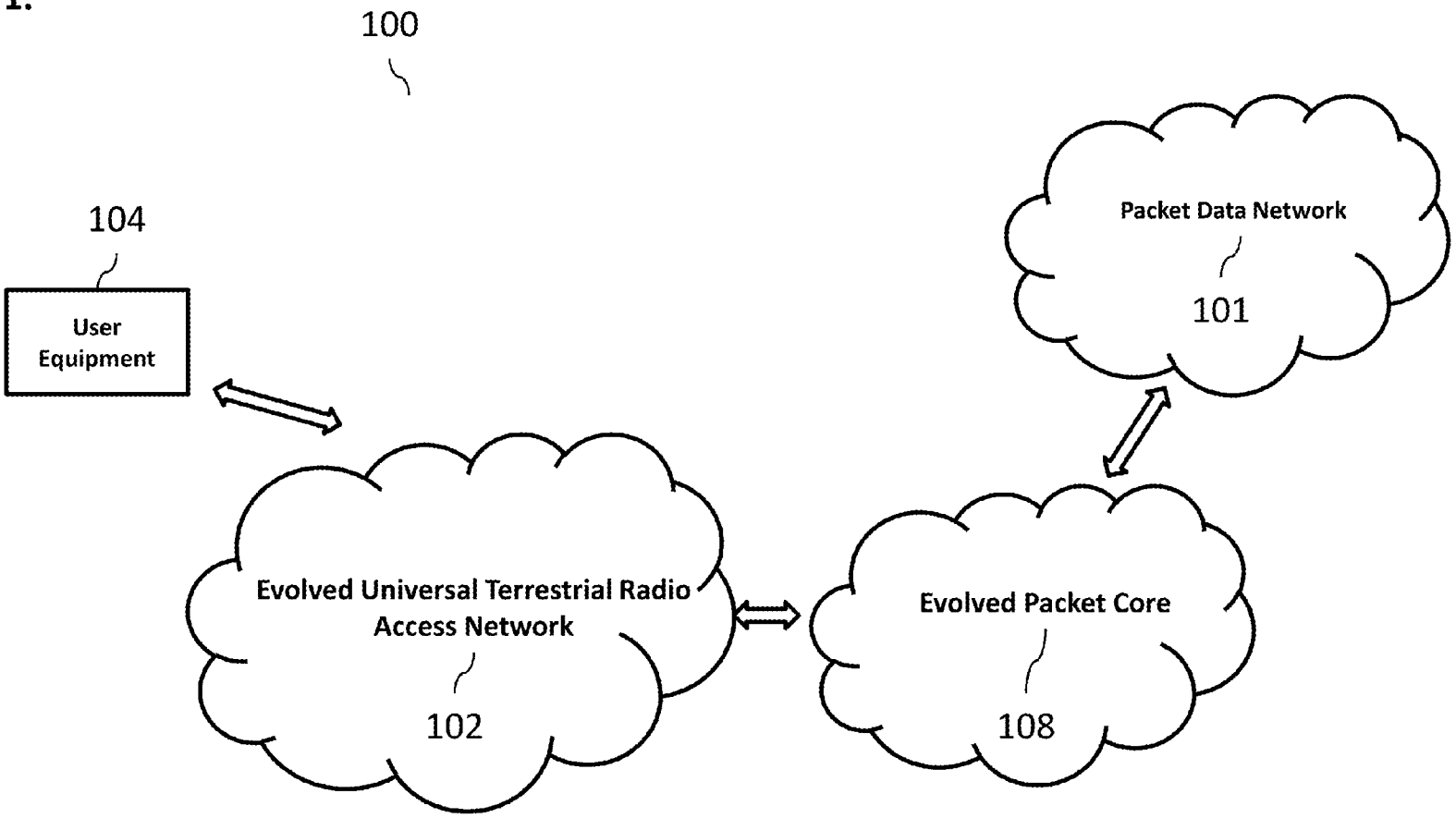
FIG. 1 illustrates an exemplary conventional Long Term Evolution ("LTE") communications system.
Figure 2:
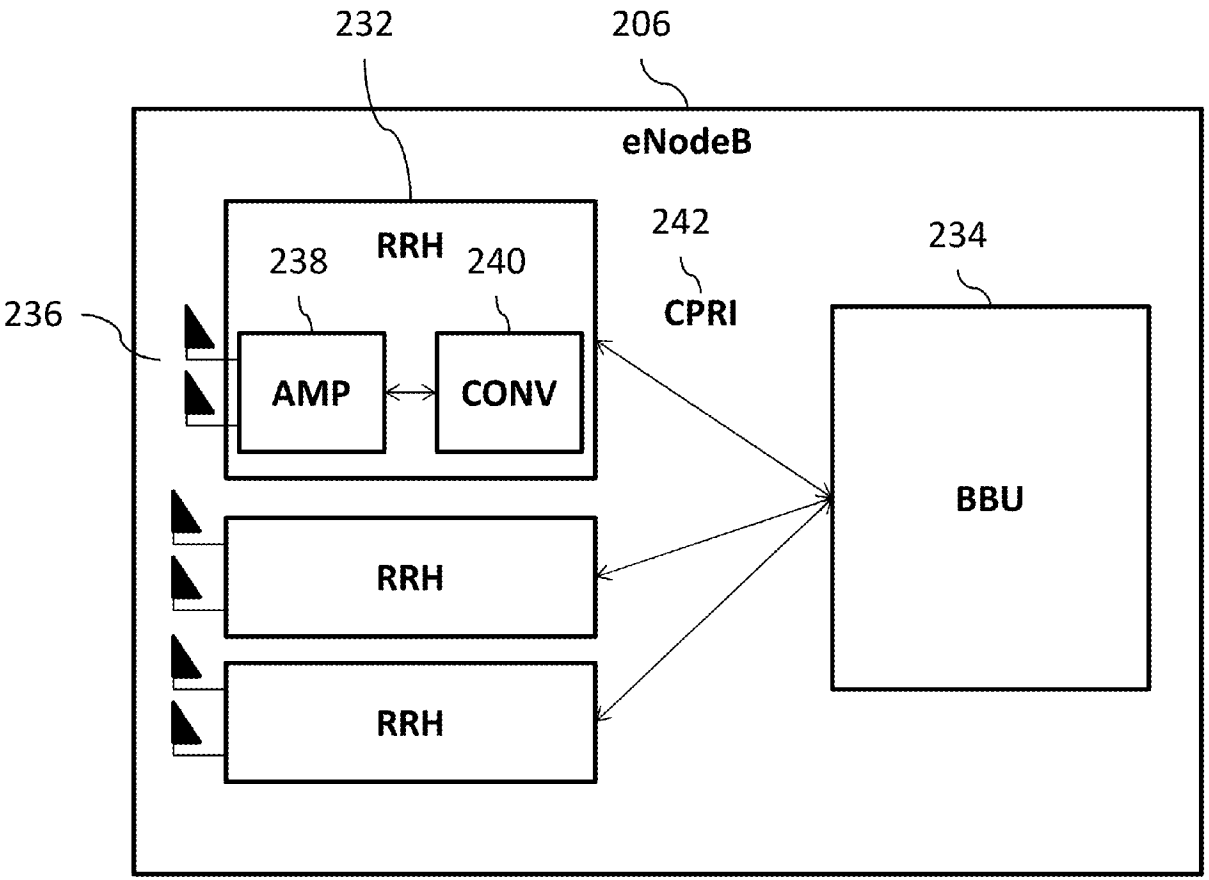
FIG. 2 illustrates an exemplary evolved Node B of the exemplary LTE system shown in FIG. 1.

FIGS. 1 and 2 illustrate an exemplary conventional Long Term Evolution ("LTE") communication system 100 along with its various components. An LTE system or a 4G LTE, as it commercially known, is governed by a standard for wireless communication of high-speed data for mobile telephones and data terminals. The standard is based on the GSM/EDGE ("Global System for Mobile Communications"/"Enhanced Data rates for GSM Evolution") as well as UMTS/HSPA ("Universal Mobile Telecommunications System"/"High Speed Packet Access") network technologies. The standard is developed by the 3GPP ("3rd Generation Partnership Project").

As shown in FIG. 1, the system 100 can include an evolved universal terrestrial radio access network ("EUTRAN") 102, an evolved packet core ("EPC") 108, and a packet data network ("PDN") 101, where the EUTRAN 102 and EPC 108 provide communication between a user equipment 104 and the PDN 101. The EUTRAN 102 can include a plurality of evolved node B's ("eNodeB" or "ENODEB" or "enodeb" or "eNB") or base stations 206 (as shown in FIG. 2) that provide communication capabilities to a plurality of user equipment 104. The user equipment 104 can be a mobile telephone, a smartphone, a tablet, a personal computer, a personal digital assistant ("PDA"), a server, a data terminal, and/or any other type of user equipment, and/or any combination thereof. The user equipment 104 can connect to the EPC 108 and eventually, the PDN 101, via any eNodeB 206. Typically, the user equipment 104 can connect to the nearest, in terms of distance, eNodeB 206. In the LTE system 100, the EUTRAN 102 and EPC 108 work together to provide connectivity, mobility and services for the user equipment 104.

As stated above, the EUTRAN 102 includes a plurality of eNodeBs 206, also known as cell sites. The eNodeBs 206 provide radio functions and perform key control functions including scheduling of air link resources or radio resource management, active mode mobility or handover, and admission control for services. The eNodeBs 206 are responsible for selecting which mobility management entities will serve the user equipment 104 and for protocol features like header compression and encryption. The eNodeBs 206 that make up an EUTRAN 102 collaborate with one another for radio resource management and handover.

FIG. 2 illustrates an exemplary structure of eNodeB 206. The eNodeB 206 can include at least one remote radio head ("RRH") 232 (typically, there can be three RRH 232 at a cell site) and a baseband unit ("BBU") 234. The RRH 232 can be connected to antennas 236. The RRH 232 and the BBU 234 can be connected using an optical interface that is compliant with common public radio interface ("CPRI") 242 standards specification. The operation of the eNodeB 206 can be characterized using the following exemplary, non-limiting standard parameters (and specifications): radio frequency band (3GPP Band 4, Band 9, Band 17, and/or others), channel bandwidth (1.4, 3, 5, 10, 15, 20 MHz), access scheme (downlink: OFDMA; uplink: SC-OFDMA), antenna technology (downlink: 2×2, 4×2, 4×4 MIMO; uplink: 1×2 single input multiple output ("SIMO") or any other modes), number of sectors (e.g., 3 or more), maximum transmission power (e.g., 60 W, which can also be more or less), maximum transmission rate (e.g., downlink: 150 Mb/s; uplink: 50 Mb/s, and/or any other values), S1/X2 interface (1000Base-SX, 1000Base-T), and mobile environment (up to 350 km/h). The BBU 234 can be responsible for digital baseband signal processing, termination of S1 line, termination of X2 line, call processing and monitoring control processing. IP packets that are received from the EPC 108 (not shown in FIG. 2) can be modulated into digital baseband signals and transmitted to the RRH 232. Conversely, the digital baseband signals received from the RRH 232 can be demodulated into IP packets for transmission to EPC 108.

The RRH 232 can transmit and receive wireless signals using antennas 236. The RRH 232 can convert (using converter ("CONV") 240) digital baseband signals from the BBU 234 into radio frequency ("RF") signals and power amplify (using amplifier ("AMP") 238) them for transmission to user equipment 104 (not shown in FIG. 2). Conversely, the RF signals that are received from user equipment 104 are amplified (using AMP 238) and converted (using CONV 240) to digital baseband signals for transmission to the BBU 234.

Figure 3:
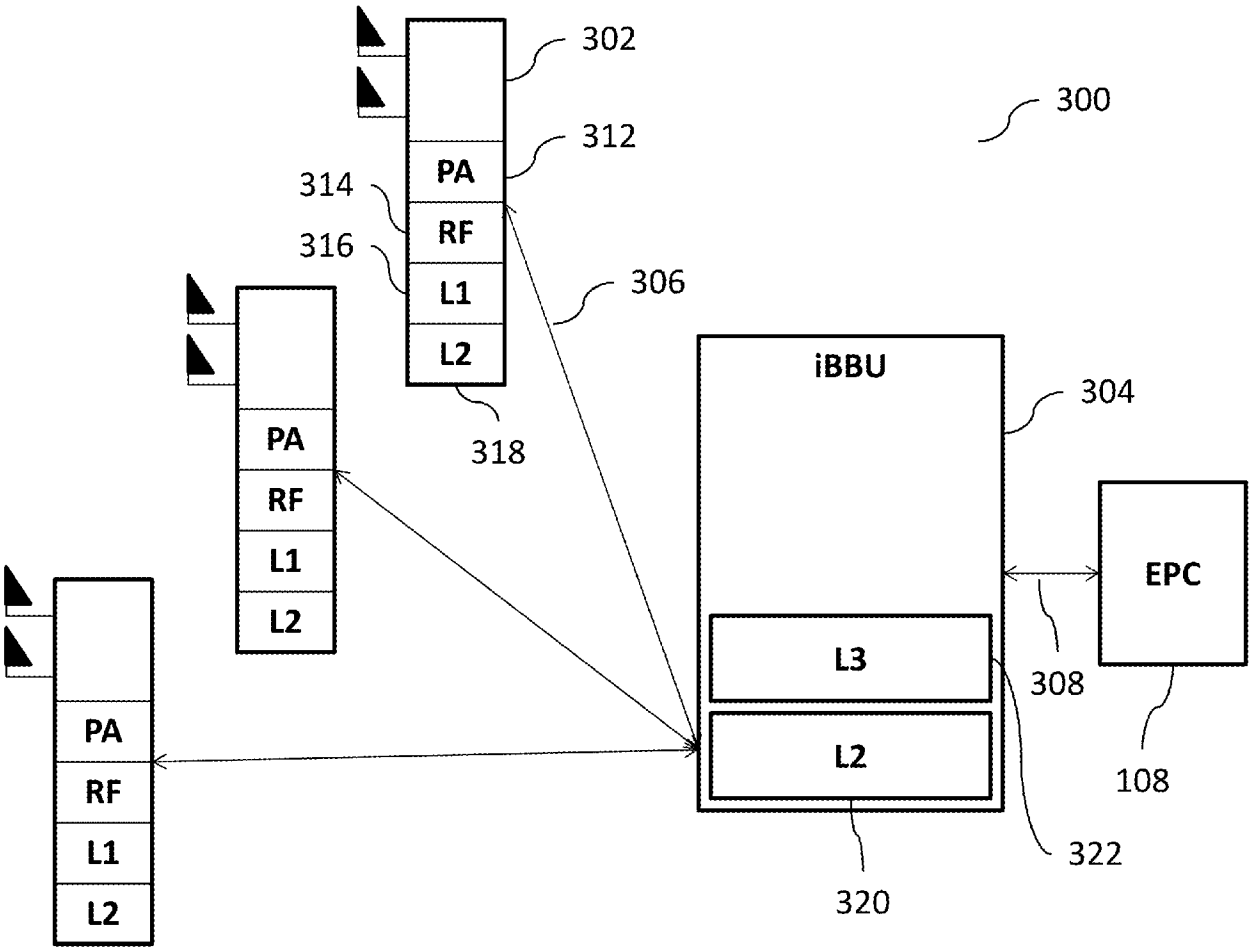
FIG. 3 illustrates an exemplary intelligent Long Term Evolution Radio Access Network, according to some implementations of the current subject matter.

FIG. 3 illustrates an exemplary system 300, according to some implementations of the current subject matter. The system 300 can be implemented as a centralized cloud radio access network ("C-RAN"). The system 300 can include at least one intelligent remote radio head ("iRRH") unit 302 and an intelligent baseband unit ("iBBU") 304. The iRRH 302 and iBBU 304 can be connected using Ethernet fronthaul ("FH") communication 306 and the iBBU 304 can be connected to the EPC 108 using backhaul ("BH") communication 308. The user equipment 104 (not shown in FIG. 3) can communicate with the iRRH 302.

In some implementations, the iRRH 302 can include the power amplifier ("PA") module 312, the radio frequency ("RF") module 314, LTE layer L1 (or PHY layer) 316, and a portion 318 of the LTE layer L2. The portion 318 of the LTE layer L2 can include the media access control ("MAC") layer and can further include some functionalities/protocols associated with radio link control ("RLC") and packet data convergence protocol ("PDCP"). The iBBU 304 can be a centralized unit that can communicate with a plurality of iRRH and can include LTE layer L3 322 (e.g., radio resource control ("RRC"), radio resource management ("RRM"), etc.) and can also include a portion 320 of the LTE layer L2. Similar to portion 318, the portion 320 can include various functionalities/protocols associated with RLC and PDCP. Thus, the system 300 can be configured to split functionalities/protocols associated with RLC and PDCP between iRRH 302 and the iBBU 304.

In some implementations, the current subject matter relates to systems, methods, and/or computer program products for assisting in installation/positioning/repositioning of a remote radio head. For the purposes of the following discussion, the reference is going to be made to an intelligent remote radio head installation. FIG. 4*a* illustrates an exemplary remote radio head 404 being installed on a light post 402. The remote radio head can be an intelligent remote radio head, as shown and discussed in connection with FIG. 3, and/or a remote radio head, as shown and discussed in connection with FIG. 2, and/or any other radio device. In some implementations, the current subject matter relates to installation/positioning/repositioning of any type of remote radio head (i.e., regardless of the radio architecture, L2 split, transport between radio and baseband, and/or any other configuration parameters). For illustrative purposes and for ease of discussion only, the following discussion will refer to an intelligent remote radio head (iRRH) 404. However, as can be understood by one having ordinary skill in the art, the present disclosure is not limited to this particular implementation and is applicable to any radio device, as stated above. Referring back to FIG. 4*a*, the iRRH 404 can be installed on any type of surface (e.g., wall, ground, mast, antenna, post, pole, etc.) and/or object (which can include a stationary object, a mobile object, etc.).

Figure 4B:
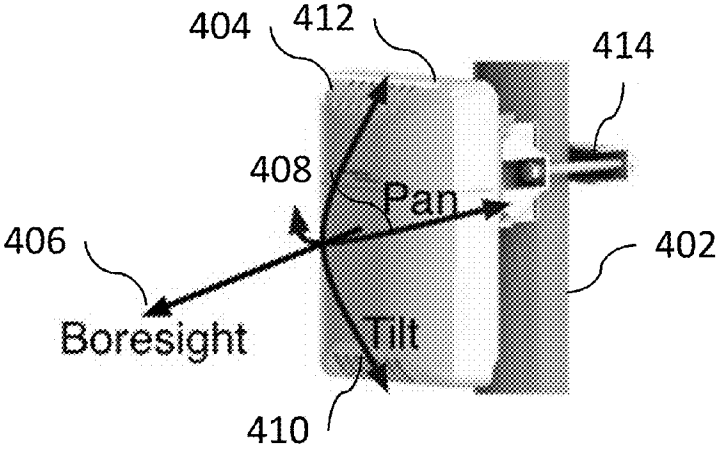
FIGS. 4*a-b* illustrate an exemplary remote radio head ("iRRH") being installed on a post, according to some implementations of the current subject matter.
Figure 4A:
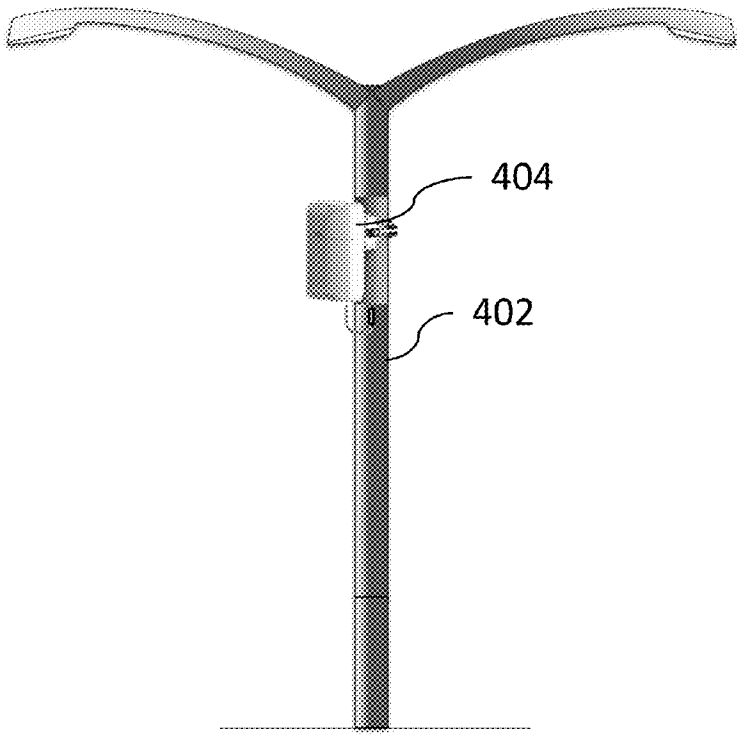

As shown in FIG. 4*b*, the iRRH 404 can typically include a housing 412 that can enclose various radio and/or electronic components of the iRRH 404. Bolts 414 can be used to attach the housing 412 to the post 402. As can be understood, any other means can be used to attach the iRRH 402 to the post 402 (and/or any other object, surface, etc.).

Accurate positioning of the iRRH 404 is important to the proper operation of the iRRH 402, otherwise various operational problems may occur. These can include, but are not limited to, signals not being properly received/transmitted by the iRRH 404, interference from other radio devices affecting in iRRH operation, as well as any other issues. To properly install the iRRH 404, the iRRH 404 might need to be positioned in a proper way. This can be accomplished by accounting for boresight 406, pan 408, and/or tilt 410 ("positioning factors" or "positioning parameters") of the iRRH 404 when it is being mounted to the post 402 (or any other installation or positioning surface). In telecommunications, antenna boresight can refer to an axis of maximum gain (i.e., maximum radiated power) of a directional antenna and for most antennas boresight can refer to the axis of symmetry of the antenna. Pan or panning can refer to rotation of the iRRH 404 about a vertical axis. Tilt or tilting can refer to rotation of the iRRH 404 in a vertical plane.

Figure 5:
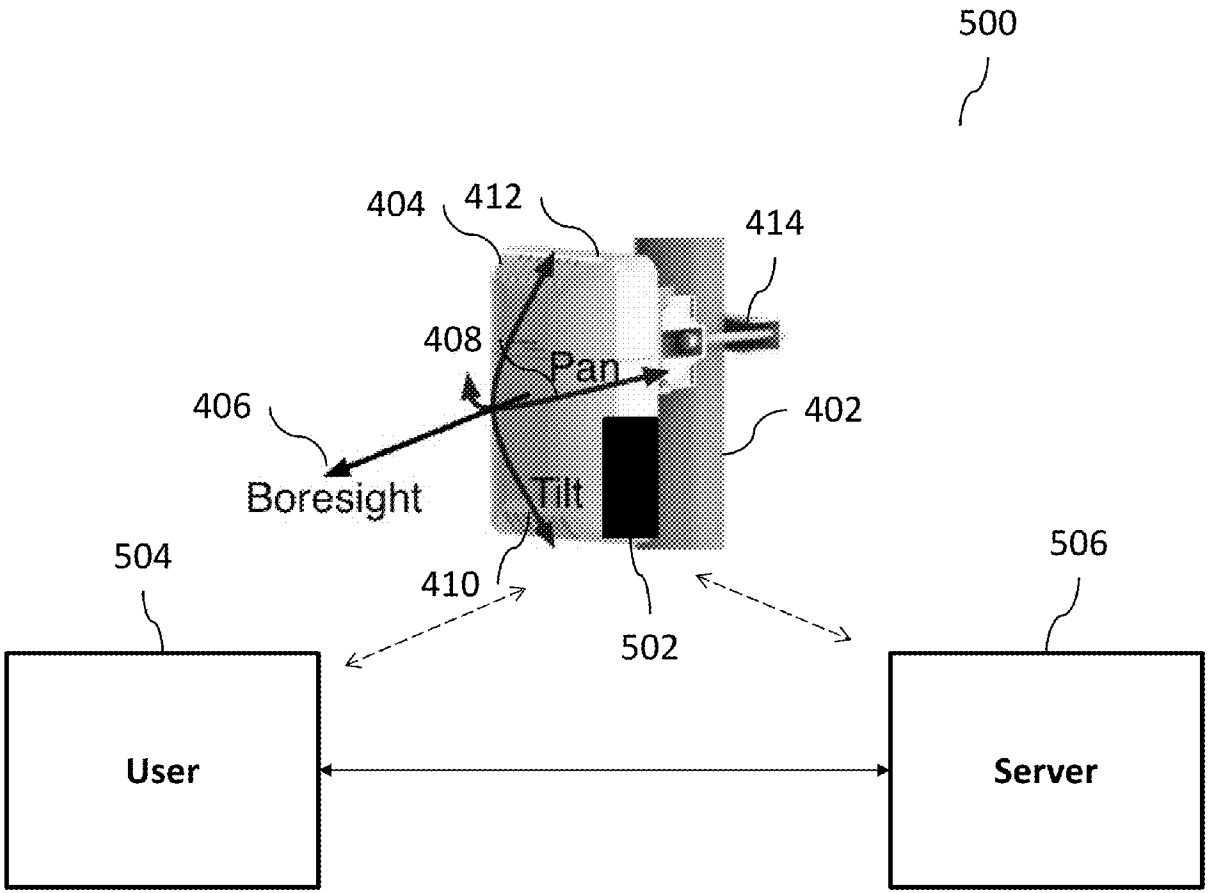
FIG. 5 illustrates an exemplary system for performing installation of an RRH, according to some implementations of the current subject matter.

FIG. 5 illustrates an exemplary system 500 for performing installation of an iRRH 404, according to some implementations of the current subject matter. The system 500 can include an installation device 502, which can be communicatively coupled to a server 506 communicating with a user 504. The installation device 502 can be an electronic device that can include software, hardware, and/or any combination thereof. For example, it can be a smartphone, a tablet, a personal computer, a laptop, a personal digital assistant, a telephone, a mobile telephone, a global positioning system device, and/or any other device, and/or any combination thereof. The device 502 can include communications capabilities that can allow it to communicate (e.g., using a wired connection, a wireless connection, and/or any other type of connection and/or any combination thereof) with the server 506 and/or the user 504.

The device 502 can be used by the user 504 to perform proper installation of the iRRH 404 on a post 402. The device 502 can be coupled to the iRRH 404 (e.g., permanently, temporarily, and/or using any means). The device 502 can be used to determine boresight, tilt, and/or pan, and/or other coordinates of the iRRH 404. In some implementations, the device 502 can include at least one sensor (e.g., a semiconductor-based sensor, etc.) that can be used to detect and/or evaluate position and/or movement (e.g., magnetic north, acceleration/deceleration of the device 502, height of the device 502 above ground and/or sea-level, angle of tilt of the device 502 in all axes, etc.). In some implementations, the boresight, pan, tilt, location, etc. can be determined by the device 502 based on the position of the device 502 relative to the orientation of its radio component. Upon determination of the boresight, tilt, and/or pan of the iRRH, as mounted, the device 502 can communicate this information to the server 506 and/or the user 504. Additionally, the device 502 can also request information from the server 506 as to the proper boresight, tilt and/or pan for that particular iRRH 404. If the received boresight, tilt and pan are the same as the ones determined by the device 502, then the device 502 can indicate to the user 504 and/or the server 506 that there is no need for any adjustment in either of the boresight, tilt, and/or pan. If one of the boresight, tilt, or pan, as determined by the device 502, differ from those received from the server, the device 502 can generate an alert to the user 504 and/or the server 506 to perform an adjustment of either of these positioning factors.

Upon receiving an alert from the device 502, the user 504 can perform an adjustment of one or more positioning factors of the iRRH 404. Once the iRRH 404 has been repositioned in accordance with the received positioning factors, the device 502 can perform a check on whether the iRRH has been positioned in accordance with the received information. This process can be repeated many times, until the iRRH 404 is properly positioned. Once the iRRH 404 has been properly positioned, the device 502 can communicate to the user 504 and/or the server 506 that the iRRH 404 has been positioned in accordance with the predetermined positioning factors that have been received from the server 506. Subsequent to this, the iRRH 404 can be deemed to be properly positioned and thus, ready for operation.

In some implementations, the server 506 can provide positioning factors and corresponding ranges of the positioning factors. The server can also indicate that if the iRRH 404 is positioned within the ranges of the positioning factors, the installation/positioning of the iRRH 404 would be proper. For example, the server 506 can indicate that the panning range can be 89.5-90.5 degrees and tilting range can be 179.5-180.5 degrees; hence, installation of the iRRH 404 at 90.1 degree pan and 179.9 degree tilt would be proper.

In some implementations, the device 502 (either alone or in combination with other mechanisms and/or motors that can be coupled to the iRRH 404 to perform movement of the iRRH 404) can perform an automatic adjustment of the positioning of the iRRH 404 in accordance with the received positioning factors. The device 502, upon receiving information concerning positioning factors, can generate an appropriate command to change one or more of the positioning factors. One or more positioning factors can be adjusted simultaneously. Alternatively, adjustment of boresight, pan, and/or tilt can be performed in accordance with any predetermined sequence.

In some implementations, the device 502 can be equipped with or coupled to (e.g., electrically, mechanically, electromechanically, wirelessly, and/or in any other manner) one or more sensors that can determine boresight, pan, tilt, and/or any other positioning factors of the iRRH 404. The sensors can determine positioning factors of the iRRH 404 and supply them to the device 502 (which can, in turn, supply them to the user 504 and/or server 506). Upon adjustment of the positioning of the iRRH 404, the sensors can determine the position of the iRRH 404 and supply that information to the device 502, which can be used to ascertain whether adjustment of the positioning of the iRRH 404 has been properly performed.

In some implementations, the user 504 can be provided with a user interface that can be used to provide the user with information as well as allow the user to enter appropriate commands for communication with the server 506 and/or the device 502. The user interface can be presented using a computing device, such as, for example, but is not being limited to, a smartphone, a tablet, a personal computer, a laptop, a personal digital assistant, a telephone, a mobile telephone, a global positioning system device, and/or any other device, and/or any combination thereof.

Figure 6:
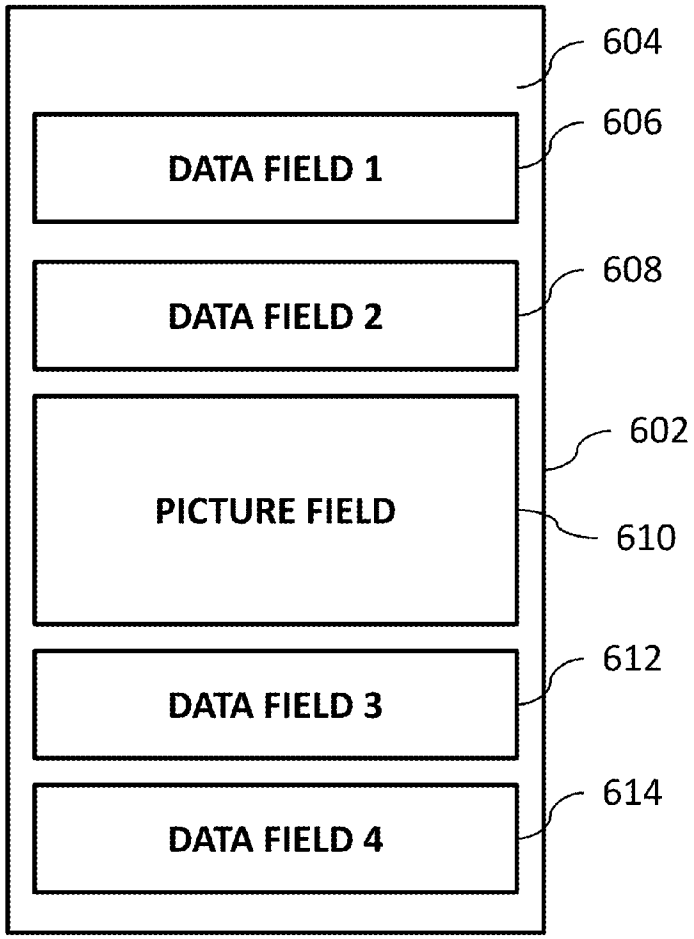
FIG. 6 illustrates an exemplary user computing device having a user interface, according to some implementations of the current subject matter.

FIG. 6 illustrates an exemplary user-computing device 602 having a user interface 604, according to some implementations of the current subject matter. The user interface 604 can include a plurality of data fields and/or a picture field. The data fields 606, 608, 612, and 614 can include information about the iRRH 404 (not shown in FIG. 6), its positioning, etc. The picture field 610 can provide a visual of the iRRH 404 before repositioning, during repositioning, and/or after repositioning. It can also provide a visual confirmation for the user that the iRRH 404 has been properly installed/positioned.

In some implementations, the data field 1 606 can display information related to position and/or location of the iRRH 404. For example, this information can include global positioning system ("GPS") location, GPS accuracy (where GPS accuracy can be related to the number of GPS satellites that the GPS receiver of the device 502 (shown in FIG. 5) can receive signals from. GPS accuracy can be measured in terms of distance (e.g., below 1 m when many satellites can be "seen" and/or received)).), address information, etc. If no coordinates exist for the iRRH 404, the user can be prompted to enter coordinate information in data field 1 606.

In some implementations, data field 2 608 can provide the user with an ability to perform various functions that may be associated with installation/positioning/repositioning of the iRRH 404. The data field 2 can display an iRRH installation sequence, and an iRRH commission sequence. In some implementations, the commission sequence can be performed by the user after completion of installation of the iRRH. The commission sequence can include at least one of the following checks: whether the iRRH is powered, whether the iRRH is communicatively coupled for transport to iBBU (e.g., an LED light and/or any other indicator can be included on the iRRH that can provide an indication of a connection), whether GPS/timing synchronization has been achieved (e.g., a fronthaul LED and/or any other indicator can be included on the iRRH that can provide a status indication of a connection), etc. If an error is encountered during the commission sequence, the user can determine whether the iRRH has been properly connected. This can involve performing at least one of the following: checking whether the power of the iRRH is on (e.g., an LED light and/or any other indicator can provide an indication whether or not the iRRH is powered on), determining the status of the iRRH, determining the status of the fronthaul connection (e.g., using a fronthaul LED light and/or any other indicator), etc. If the commission sequence fails, the user can gather various information, as to the potential causes of the failure of the commission sequence, for further analysis. The data field 2 can also provide information as to any driving directions to where the iRRH is located, as well as any other information.

In some implementations, the installation sequence can include at least one of the following operations: checking product (i.e., iRRH) and site information, scanning barcode/serial number of the iRRH, capturing and/or confirming iRRH installation/positioning/repositioning details (e.g., location, boresight, pan, tilt, etc.), determining GPS location, determining installation/positioning/repositioning height, determining boresight direction (e.g., direction of front face of the iRRH), and determining iRRH tilt achieved. As part of the installation sequence, the device 502 can calculate and indicate errors (e.g., location is incorrect, height is wrong, etc.). Additionally, photograph(s) of location and/or comments can be obtained with regard to the installation/positioning/repositioning.

In some implementations, a site installation error report can be generated. If error and/or fault found during installation/positioning/repositioning, the user can report the error and/or fault to server 506 (not shown in FIG. 6). The user can photograph the iRRH as part of the report and/or provide comments with regard to the problem encountered. The report can be sent to the server 506 for analysis and/or support request. Further, as part of the installation/positioning/repositioning, the system 500 (shown in FIG. 5) can exchange various data. This can include, for example, at least one of the following: an installation report and confirmation of any data sent/received between components of the system 500, fault/error reports, etc. Additionally, the device 502 can also have an ability to store any data associated with installation/positioning/repositioning and provide it to the user 504 and/or server 506 at a later time (such as when cellular coverage becomes available).

In some implementations, to properly position the iRRH in accordance with provided boresight information, the following procedure can be followed. The device 502 (shown in FIG. 5) can be placed on a horizontal reference position on the iRRH in the correct orientation. Then, the device 502 can ascertain compass bearing of the iRRH. The compass bearing can assist the user in determining boresight of the iRRH. In some implementations, to aid in the alignment process, the device 502 can also be used together with a jig device, which can assist in properly positioning the device 502 and the iRRH.

Alternatively, a photograph of the iRRH can be taken and used by the device 502 as a reference for alignment purposes. The device 502 can placed on the iRRH and when alignment is achieved, device 502 can automatically determine boresight of the iRRH. If the device 502 determines that there is a misalignment of the iRRH with regard to the reference position (e.g., by a few degrees), the device 502 can be used to adjust the reading of the boresight to allow for such offset to the position.

In some implementations, during boresight positioning, the device 502 can determine GPS location of the iRRH, height position (above ground) of the iRRH, compass angle of the iRRH, and can also take a photograph of the device. The device 502 can also determine an angle of the iRRH boresight with regard to the Magnetic North. The device 502 can also determine and display any errors that may be encountered during installation.

In some implementations, to properly position the iRRH in accordance with the provided tilt information, the following procedure can be used. The device 502 (shown in FIG. 5) can be placed on an upright reference position on the iRRH in a predetermined orientation and the device 502 can determine compass bearing of the iRRH. As stated above, a jig device (e.g., a device that can be used to assist and/or control positioning and/or motion) can be used together with the device 502 to aid in installation.

Alternatively, as stated above, a photograph of the iRRH can be taken and used by the device 502 as a reference for alignment purposes. The device 502 can placed on the iRRH and when alignment is achieved, device 502 can automatically determine tilt of the iRRH. If the device 502 determines that there is a misalignment of the iRRH with regard to the reference position (e.g., by a few degrees), the device 502 can be used to adjust the reading of the tilt to allow for such offset to the position.

In some implementations, during tilt positioning, the device 502 can determine location of the iRRH and tilt angle. Based on this information, the device 502 can determine an angle of iRRH position with regard to a vertical axis. The device 502 can also display any errors that may be determined as a result of this installation.

In some implementations, the picture field 610 can include information relating to product picture, map information of where the iRRH is located, as well as information about the iRRH being installed.

In some implementations, the data field 3 612 can illustrate functional status with regard to installation/positioning/repositioning of the iRRH. The data field 3 can illustrate further information about the iRRH that is being installed/positioned/repositioned, allow user to enter information about the iRRH (e.g., serial number, size, etc.), provide steps of the commissioning sequence to the user, allow the user to forward information and/or data about the iRRH to the server 506 (not shown in FIG. 6).

In some implementations, the data field 4 614 can illustrate additional functional status with regard to installation/positioning/repositioning of the iRRH. Such information can include various error messages relating to installation/positioning/repositioning (e.g., incorrect positioning, wrong iRRH, failure to operate, etc.), an indication of whether any data that is sent to the server 506 has and/or has not been received, as well as any other information.

Figure 7:
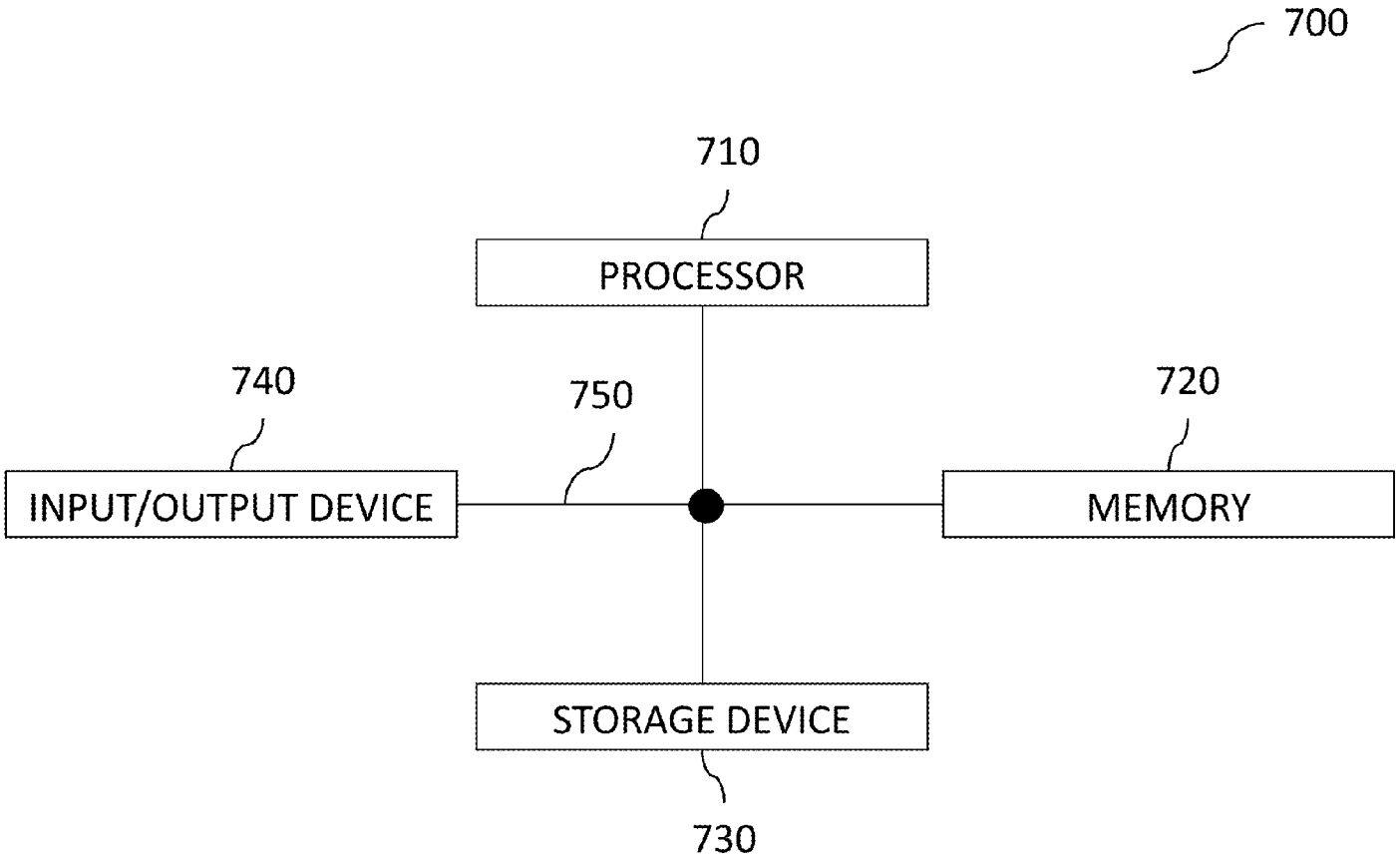
FIG. 7 illustrates an exemplary system, according to some implementations of the current subject matter.

In some implementations, the current subject matter can be configured to be implemented in a system 700, as shown in FIG. 7. The system 700 can include one or more of a processor 710, a memory 720, a storage device 730, and an input/output device 740. Each of the components 710, 720, 730 and 740 can be interconnected using a system bus 750. The processor 710 can be configured to process instructions for execution within the system 400. In some implementations, the processor 710 can be a single-threaded processor. In alternate implementations, the processor 710 can be a multi-threaded processor. The processor 710 can be further configured to process instructions stored in the memory 720 or on the storage device 730, including receiving or sending information through the input/output device 740. The memory 720 can store information within the system 700. In some implementations, the memory 720 can be a computer-readable medium. In alternate implementations, the memory 720 can be a volatile memory unit. In yet some implementations, the memory 720 can be a non-volatile memory unit. The storage device 730 can be capable of providing mass storage for the system 700. In some implementations, the storage device 730 can be a computer-readable medium. In alternate implementations, the storage device 730 can be a floppy disk device, a hard disk device, an optical disk device, a tape device, non-volatile solid-state memory, or any other type of storage device. The input/output device 740 can be configured to provide input/output operations for the system 700. In some implementations, the input/output device 740 can include a keyboard and/or pointing device. In alternate implementations, the input/output device 740 can include a display unit for displaying graphical user interfaces.

Figure 8:
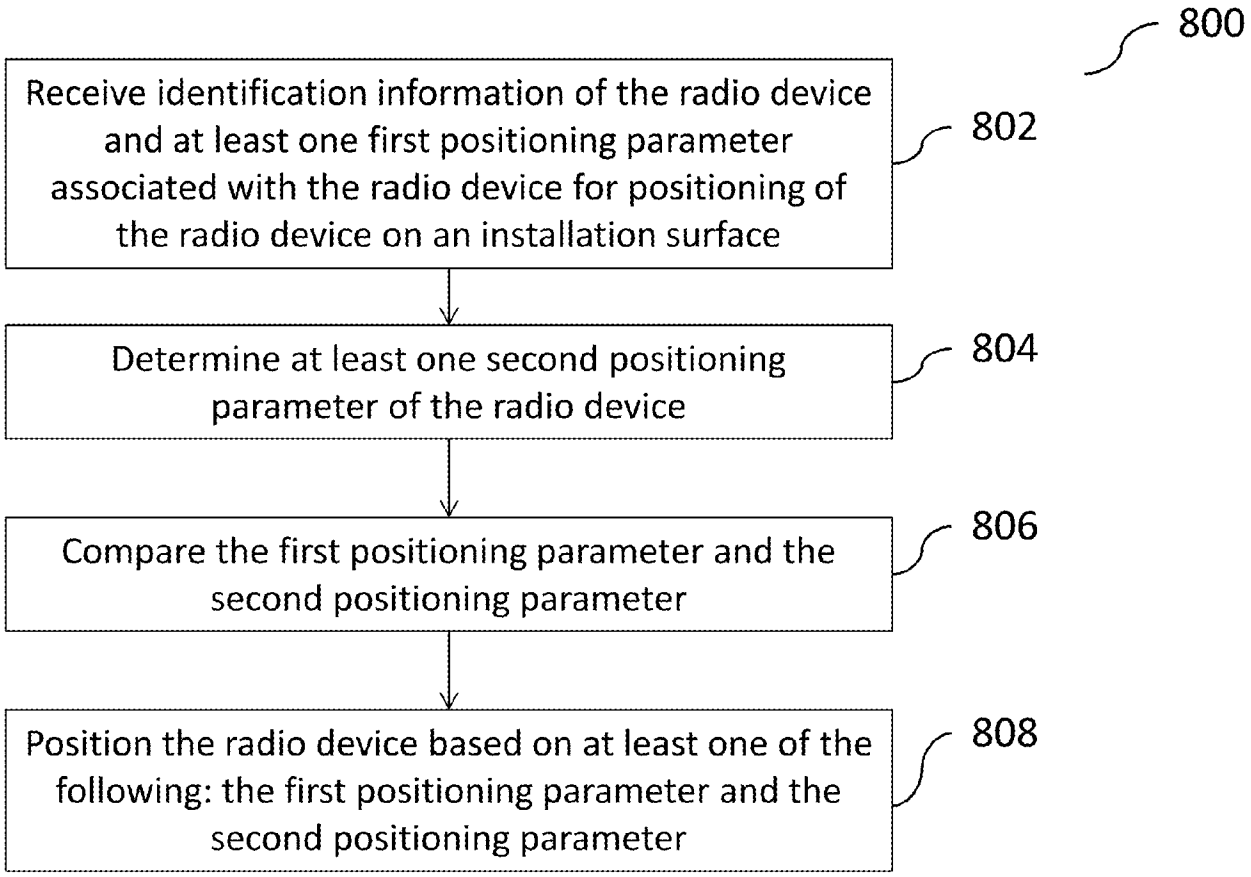
FIG. 8 illustrates an exemplary method, according to some implementations of the current subject matter.

FIG. 8 illustrates an exemplary method 800 for performing positioning of a remote radio device (e.g., iRRH 404 shown in FIG. 4*a*, RRH as shown in FIG. 2, and/or any radio device), according to some implementations of the current subject matter. At 802, a positioning device (e.g., device 502 shown in FIG. 5) can receive an identification information of the radio device and at least one first positioning parameter (e.g., boresight, pan, tilt, etc.) associated with the radio device for positioning of the radio device on an installation surface (e.g., a light post, a tower, a wall, etc.). At 804, the positioning device can be used to determine at least one second positioning parameter of the radio device (e.g., current position of the device). At 806, the positioning parameters can be compared. At 808, based on the comparison, the radio device can be positioned based on at least one of the following: the first positioning parameter and the second positioning parameter.

In some implementations, the current subject matter can include one or more of the following optional features. The radio device can be communicatively coupled to an evolved node (eNodeB) base station. The eNodeB base station can include at least one processor and at least one memory.

In some implementations, the first positioning parameter and the second positioning parameter can include at least one of the following: a boresight of the radio device, a tilt of the radio device, and/or a pan of the radio device.

In some implementations, the positioning device can be coupled to the radio device. Then, the boresight of the radio device, the tilt of the radio device, and the pan of the radio device can be determined based on at least one corresponding boresight of the radio device, tilt of the radio device, and pan of the positioning device.

In some implementations, the positioning device can remotely communicate with the radio device. Here, the boresight of the radio device, the tilt of the radio device, and the pan of the radio device can also be determined based on at least one corresponding boresight of the radio device, tilt of the radio device, and pan of the positioning device.

In some implementations, at least one of the boresight of the radio device, the tilt of the radio device, and the pan of the radio device can be determined based on at least one of the following: a location of the radio device, a height of the radio device above a ground surface, a compass angle of the radio device, a photograph of the radio device, a tilt angle of the radio device, an angle of the radio device with respect to a vertical axis, and an angle of the radio device with respect to Magnetic North.

In some implementations, the method can further include determining, based on the comparison, that the radio device has been incorrectly positioned, and repositioning the radio device based on at least one of the following: the first positioning parameter and the second positioning parameter.

The systems and methods disclosed herein can be embodied in various forms including, for example, a data processor, such as a computer that also includes a database, digital electronic circuitry, firmware, software, or in combinations of them. Moreover, the above-noted features and other aspects and principles of the present disclosed implementations can be implemented in various environments. Such environments and related applications can be specially constructed for performing the various processes and operations according to the disclosed implementations or they can include a general-purpose computer or computing platform selectively activated or reconfigured by code to provide the necessary functionality. The processes disclosed herein are not inherently related to any particular computer, network, architecture, environment, or other apparatus, and can be implemented by a suitable combination of hardware, software, and/or firmware. For example, various general-purpose machines can be used with programs written in accordance with teachings of the disclosed implementations, or it can be more convenient to construct a specialized apparatus or system to perform the required methods and techniques.

The systems and methods disclosed herein can be implemented as a computer program product, i.e., a computer program tangibly embodied in an information carrier, e.g., in a machine readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

As used herein, the term "user" can refer to any entity including a person or a computer.

Although ordinal numbers such as first, second, and the like can, in some situations, relate to an order; as used in this document ordinal numbers do not necessarily imply an order. For example, ordinal numbers can be merely used to distinguish one item from another. For example, to distinguish a first event from a second event, but need not imply any chronological ordering or a fixed reference system (such that a first event in one paragraph of the description can be different from a first event in another paragraph of the description).

The foregoing description is intended to illustrate but not to limit the scope of the invention, which is defined by the scope of the appended claims. Other implementations are within the scope of the following claims.

These computer programs, which can also be referred to programs, software, software applications, applications, components, or code, include machine instructions for a programmable processor, and can be implemented in a high-level procedural and/or object-oriented programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

To provide for interaction with a user, the subject matter described herein can be implemented on a computer having a display device, such as for example a cathode ray tube (CRT) or a liquid crystal display (LCD) monitor for displaying information to the user and a keyboard and a pointing device, such as for example a mouse or a trackball, by which the user can provide input to the computer. Other kinds of devices can be used to provide for interaction with a user as well. For example, feedback provided to the user can be any form of sensory feedback, such as for example visual feedback, auditory feedback, or tactile feedback; and input from the user can be received in any form, including, but not limited to, acoustic, speech, or tactile input.

The subject matter described herein can be implemented in a computing system that includes a back-end component, such as for example one or more data servers, or that includes a middleware component, such as for example one or more application servers, or that includes a front-end component, such as for example one or more client computers having a graphical user interface or a Web browser through which a user can interact with an implementation of the subject matter described herein, or any combination of such back-end, middleware, or front-end components. The components of the system can be interconnected by any form or medium of digital data communication, such as for example a communication network. Examples of communication networks include, but are not limited to, a local area network ("LAN"), a wide area network ("WAN"), and the Internet.

The computing system can include clients and servers. A client and server are generally, but not exclusively, remote from each other and typically interact through a communication network. The relationship of client and server arises by virtue of computer programs running on the respective computers and having a client-server relationship to each other.

The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and sub-combinations of the disclosed features and/or combinations and sub-combinations of several further features disclosed above. In addition, the logic flows depicted in the accompanying figures and/or described herein do not necessarily require the particular order shown, or sequential order, to achieve desirable results. Other implementations can be within the scope of the following claims.

What is claimed:

1. A computer-implemented method for positioning of a radio device, the method comprising:

receiving, using a positioning device, an identification information of the radio device and at least one first positioning parameter associated with the radio device for positioning of the radio device on an installation surface;

determining, using the positioning device, at least one second positioning parameter of the radio device;

comparing, using the positioning device, the at least one first positioning parameter and the at least one second positioning parameter; and positioning, based on the comparison, the radio device based on at least one of the following: the at least one first positioning parameter and the at least one second positioning parameter;

wherein the at least one first positioning parameter and the at least one second positioning parameter include at least one of the following: a boresight of the radio device, a tilt of the radio device, and a pan of the radio device.

2. The method according to claim 1, wherein the radio device is communicatively coupled to an evolved node (eNodeB) base station, the eNodeB base station comprising at least one processor and at least one memory.

3. The method according to claim 1, wherein the positioning device is coupled to the radio device;

wherein at least one of the boresight of the radio device, the tilt of the radio device, and the pan of the radio device is determined based on at least one corresponding boresight of the radio device, tilt of the radio device, and pan of the positioning device.

4. The method according to claim 1, wherein the positioning device remotely communicates with the radio device;

wherein at least one of the boresight of the radio device, the tilt of the radio device, and the pan of the radio device is determined based on at least one corresponding boresight of the radio device, tilt of the radio device, and pan of the positioning device.

5. The method according to claim 1, wherein at least one of the boresight of the radio device, the tilt of the radio device, and the pan of the radio device is determined based on at least one of the following: a location of the radio device, a height of the radio device above a ground surface, a compass angle of the radio device, a photograph of the radio device, a tilt angle of the radio device, an angle of the radio device with respect to a vertical axis, and an angle of the radio device with respect to Magnetic North.

6. The method according to claim 1, further comprising determining, based on the comparison, that the radio device has been incorrectly positioned; and repositioning the radio device based on at least one of the following: the at least one first positioning parameter and the at least one second positioning parameter.

7. A computer program product, for transmitting data packets, comprising a non-transitory machine-readable medium storing instructions that, when executed by at least one programmable processor, cause the at least one programmable processor to perform operations comprising:

receiving, using a positioning device, an identification information of the radio device and at least one first positioning parameter associated with the radio device for positioning of the radio device on an installation surface;

determining, using the positioning device, at least one second positioning parameter of the radio device;

comparing, using the positioning device, the at least one first positioning parameter and the at least one second positioning parameter; and positioning, based on the comparison, the radio device based on at least one of the following: the at least one first positioning parameter and the at least one second positioning parameter;

wherein the at least one first positioning parameter and the at least one second positioning parameter include at least one of the following: a boresight of the radio device, a tilt of the radio device, and a pan of the radio device.

8. The computer program product according to claim 7, wherein the radio device is communicatively coupled to an evolved node (eNodeB) base station, the eNodeB base station comprising at least one processor and at least one memory.

9. The computer program product according to claim 7, wherein the positioning device is coupled to the radio device;

wherein at least one of the boresight of the radio device, the tilt of the radio device, and the pan of the radio device is determined based on at least one corresponding boresight of the radio device, tilt of the radio device, and pan of the positioning device.

10. The computer program product according to claim 7, wherein the positioning device remotely communicates with the radio device;

wherein at least one of the boresight of the radio device, the tilt of the radio device, and the pan of the radio device is determined based on at least one corresponding boresight of the radio device, tilt of the radio device, and pan of the positioning device.

11. The computer program product according to claim 7, wherein at least one of the boresight of the radio device, the tilt of the radio device, and the pan of the radio device is determined based on at least one of the following: a location of the radio device, a height of the radio device above a ground surface, a compass angle of the radio device, a photograph of the radio device, a tilt angle of the radio device, an angle of the radio device with respect to a vertical axis, and an angle of the radio device with respect to Magnetic North.

12. The computer program product according to claim 7, wherein the operations further comprise determining, based on the comparison, that the radio device has been incorrectly positioned; and repositioning the radio device based on at least one of the following: the at least one first positioning parameter and the at least one second positioning parameter.

13. A device for transmission of data packets, comprising:

at least one memory; and at least one processor operatively coupled to the memory, the at least one processor being configured to:

receive, using a positioning device, an identification information of the radio device and at least one first positioning parameter associated with the radio device for positioning of the radio device on an installation surface;

determine, using the positioning device, at least one second positioning parameter of the radio device;

compare, using the positioning device, the at least one first positioning parameter and the at least one second positioning parameter; and position, based on the comparison, the radio device based on at least one of the following: the at least one first positioning parameter and the at least one second positioning parameter;

wherein the at least one first positioning parameter and the at least one second positioning parameter include at least one of the following: a boresight of the radio device, a tilt of the radio device, and a pan of the radio device.

14. The device according to claim 13, wherein the radio device is communicatively coupled to an evolved node (eNodeB) base station, the eNodeB base station comprising at least one processor and at least one memory.

15. The device according to claim 13, wherein the positioning device is coupled to the radio device;

wherein at least one of the boresight of the radio device, the tilt of the radio device, and the pan of the radio device is determined based on at least one corresponding boresight of the radio device, tilt of the radio device, and pan of the positioning device.

16. The device according to claim 13, wherein the positioning device remotely communicates with the radio device;

wherein at least one of the boresight of the radio device, the tilt of the radio device, and the pan of the radio device is determined based on at least one corresponding boresight of the radio device, tilt of the radio device, and pan of the positioning device.

17. The device according to claim 13, wherein at least one of the boresight of the radio device, the tilt of the radio device, and the pan of the radio device is determined based on at least one of the following: a location of the radio device, a height of the radio device above a ground surface, a compass angle of the radio device, a photograph of the radio device, a tilt angle of the radio device, an angle of the radio device with respect to a vertical axis, and an angle of the radio device with respect to Magnetic North.

18. The device according to claim 13, wherein the operations further comprise determining, based on the comparison, that the radio device has been incorrectly positioned; and repositioning the radio device based on at least one of the following: the at least one first positioning parameter and the at least one second positioning parameter.

* * * * *